United States Patent [19]

Chapman

[11] Patent Number: 4,665,820

[45] Date of Patent: May 19, 1987

[54] PRINT BAND TIMING MARK DETECTOR

[75] Inventor: Walter C. Chapman, Allenton, Mich.

[73] Assignee: Centronics Data Computer Corp., Hudson, N.H.

[21] Appl. No.: 834,770

[22] Filed: Feb. 28, 1986

[51] Int. Cl.[4] ..... B41J 1/20

[52] U.S. Cl. ..... 101/93.14; 400/146; 307/354; 328/150

[58] Field of Search ..... 400/146; 101/93.14, 101/111; 307/354, 252 UP; 328/150; 330/110

[56] References Cited

U.S. PATENT DOCUMENTS

| | | | |
|---|---|---|---|
| 3,541,457 | 11/1970 | Leighty | 328/150 |
| 3,566,283 | 2/1971 | Diebler | 328/150 |
| 3,573,495 | 4/1971 | Xylander | 307/362 |
| 3,576,451 | 4/1971 | Markow | 328/150 X |
| 3,718,864 | 2/1973 | Kelly | 307/354 X |
| 3,916,328 | 10/1975 | Wilson | 328/150 |
| 3,944,936 | 3/1976 | Pryor | 328/150 |
| 4,112,381 | 9/1978 | Mortensen | 328/150 |
| 4,268,764 | 5/1981 | Eckert | 307/354 |
| 4,315,220 | 2/1982 | Findeisen | 328/150 |
| 4,333,024 | 6/1982 | Maussion | 307/351 |
| 4,345,169 | 8/1982 | Saleh | 307/354 |
| 4,406,988 | 9/1983 | Scholz | 328/150 |
| 4,479,430 | 10/1984 | Nakano | 101/93.14 |
| 4,480,200 | 10/1984 | Tan | 307/354 |
| 4,609,869 | 9/1986 | Metcalf | 307/354 X |

FOREIGN PATENT DOCUMENTS

| | | | |
|---|---|---|---|
| 91673 | 7/1980 | Japan | 101/93.14 |

OTHER PUBLICATIONS

*IBM Tech. Disc. Bulletin*, by L. D. Richards, vol. 19, No. 9, Feb. 1977, pp. 3305–3306.

*IBM Tech. Disc. Bulletin*, by W. Sakmann, vol. 22, No. 5, Oct. 1979, p. 1938.

*Primary Examiner*—Paul T. Sewell

*Attorney, Agent, or Firm*—Pahl, Lorusso & Loud

[57] ABSTRACT

In the print band timing system described herein, the bipolar pulse generated in a sensor by the passage of a print band timing mark is applied to a discriminating circuit which compares the pulse signal with a voltage level substantially equal to the nominal d.c. level of the sensor signal. Hystereis is provided in one direction only so that the nominal zero crossing is precisely determined in a time position relationship.

7 Claims, 5 Drawing Figures

PRINT BAND TIMING MARK DETECTOR

BACKGROUND OF THE INVENTION

The present invention relates to print band timing and more particularly to a detector circuit for precisely determining the time at which a timing mark on the print band passes a sensor responsive to the mark.

As is understood by those skilled in the printing art, many high speed computer printers utilize type fonts which are carried by a moving band. To effect printing, a hammer is actuated as a desired character on the band passes the column position where printing of that character is desired. In order to effect this sort of printing operation without skewing of the characters, it is necessary to precisely determine the position of the band. For this purpose, it is typical for the band itself to carry raised points or bars whose passage can be detected by a magnetic sensor and which therefore can act as timing marks. These raised points or bars are typically formed at the same time and by the same process which forms the font on the band.

Magnetic sensing is usually preferred for the band timing function since the print band typically operates in a dusty and dirty environment in which optical sensing would be difficult. Typically, sensing of the timing marks is accomplished magnetically by a magneto resistor though other types of magnetic sensors might also be used. In general, such sensors generate a bipolar pulse in response to the passing of one of the timing marks.

Since the length and magnitude of the bipolar pulse can vary depending upon many factors, e.g. the material of the particular band, the size of the mark, the spacing between the band and the sensor and the amount of wear experienced by the band, it has been found that most accurate operation is obtained if timing is taken from the mid-point transistion of the bipolar waveform. Heretofore, the magnetic sensors used for this purpose have typically been connected in a bridge circuit which was then balanced through resistor selection or adjustment in the final working magnetic environment. As will be understood by those skilled in the art, such individual adjustment or calibration is relatively time consuming and expensive in the context of an efficient manufacturing operation.

Among the several objects of the present invention may be noted the provision of a novel print band timing system; the provision of such a system in which the time of passing of a print band timing mark may be precisely determined; the provision of such a system which employs conventional timing marks and magnetic sensors which generate a bipolar pulse in response to the passing of a print band timing mark; the provision of such a system which precisely determines the nominal zero crossing of the bipolar pulse generated by the passing of a print band timing mark; the provision of such a system which is relatively insensitive to noise and d.c. drift; the provision of such a system which is highly reliable and which is of relatively simple and inexpensive manufacture. Other objects and features will be in part apparent and in part pointed out hereinafter.

SUMMARY OF THE INVENTION

Briefly, a print band timing mark detector system according to the present invention utilizes a sensing circuit of the type which generates a bipolar pulse responsive to the passage of a print band timing mark. A capacitive filter provides a d.c. reference voltage substantially equal to the nominal d.c. level of the sensor signal. This d.c. reference level is applied to the inverting input of a differential amplifier. Through a first mixing resistance, a linear component proportional to the sensor signal is applied to the non-inverting amplifier input. A non-linear function of the amplifier output is also applied to the non-inverting input, e.g. by connecting the output of the amplifier to the non-inverting input through a second mixing resistance and a diode. Accordingly, the amplifier responds to the passage of a print band timing mark by generating a squarewave signal having one edge which is precisely aligned with the nominal zero crossing of the bipolar pulse generated by the sensor.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
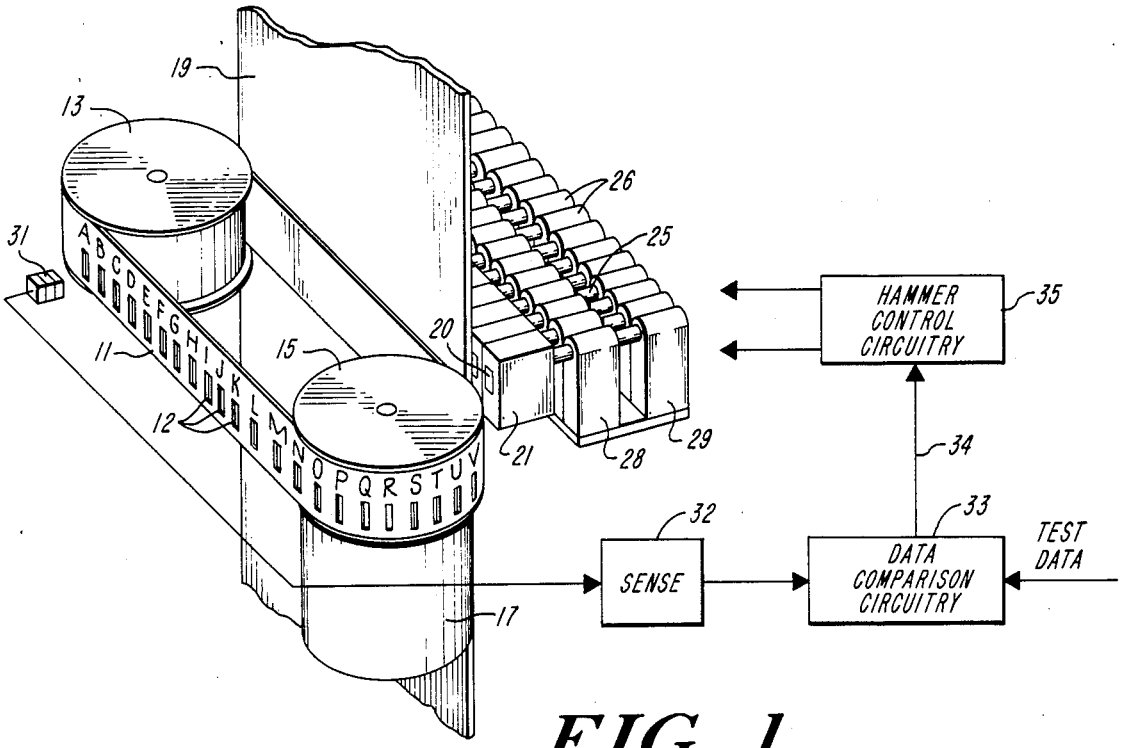
FIG. 1 is a diagrammatic illustration of computer printer apparatus of the type with which the print band timing mark detection system of the present invention is useful.

Referring now to the FIG. 1 diagram of a high speed band printer, it may be noted that an endless type-carrying band 11 passes over a pair of pulleys 13 and 15, one of which is driven by a suitably speed-controlled motor 17. One side of the band 11 passes closely adjacent a web of paper 19 on which printing is to be produced. As is understood, an inked ribbon (not shown) is typically interposed between the band and paper. The portion of the band adjacent the paper is typically also backed by a platen (not shown) so as to resist the impact of print hammers.

A multiplicity of sliding hammers 20, e.g., one for each columnar position, are held in a hammer guide bar 21 which is mounted on the opposite side of the paper web 19 from the print band. Individual hammers are driven, through push rods 25 from magnetic actuators 26 arranged in two banks 28 and 29. As indicated previously, the required physical size of the actuators 26 is such that they may not be placed in a single linear array with the desired columnar spacing. However, by interleaving the push rods and staggering the actuators, either in upper and lower rows or in axially separated rows or both, the desired close spacing of the hammers themselves may be obtained. A particular actuator construction facilitating such arrangement is described in greater detail in U.S. Pat. No. 4,532,862 issued Aug. 6, 1985 to James R. Moss, but the present brief description is included to facilitate an understanding of the environment in which the sensing circuitry of the present invention operates.

The circuitry 33 which compares text data representing a line of characters to be printed with the data representing the font on the band 11 is essentially conventional and is not described in detail herein. Basically, however, it will be understood that the control circuitry defines a succession of print cycles during which printing may take place and a control bit is issued for each actuator which is to be fired during that print cycle. Print cycles are performed repeatedly until all requested characters have been printed in the desired columns. As is also understood, the number of print cycles which may be required to print a given line of text will vary on a statistical basis depending on the actual text which is to be printed and the position of the print band at the moment printing is initiated for that line of print.

A typical band printer constructed for business purposes will provide for 132 columns of print on each line. Thus, in a hammer per column system, the control circuitry 33 must generate one bit of information for each column, the bit being set or not depending on whether the hammer is to be fired or not, during each print cycle. This information may, in one sense, be thought of as a 132 bit binary word. In actual practice, this binary word is typically generated by the comparison circuitry 33 in serial, i.e., bit sequential, fashion rather than through 132 parallel leads. In FIG. 1, such a serial data path is designated generally by reference character 34. This serial print cycle data is provided to hammer control circuitry, designated generally by reference character 35. A preferred form of hammer control circuitry is disclosed in copending U.S. patent application Ser. No. 721,994 entitled Impact Printer With Magnetic Interaction Compensation, filed Apr. 11, 1985 by Robert E. Costello.

As indicated previously, the proper operation and timing of the print control and hammer control circuitry depends upon accurate determination of the time at which each timing mark 12 passes the magnetic sensor. In accordance with the practice of the present invention, such passages are accurately determined by incorporating the magnetic sensor in a novel sensing circuit, this sensing circuit being represented in FIG. 1 by reference character 32 and being illustrated in greater detail in FIG. 3.

Figure 2:
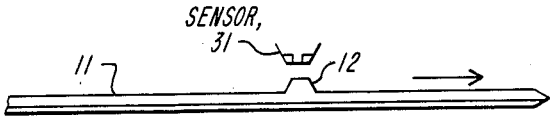
FIG. 2 is a view, in section and to enlarged scale, of a portion of the apparatus of FIG. 1 illustrating a portion of a print band and a magneto resistive sensor in cooperative relationship with a timing mark carried by the band.

As indicated previously, the band 11 carries timing marks 12 which are in the nature of raised points or bars, the passages of which may be detected by an appropriately positioned magnetic sensor 31. With reference to FIG. 2, which may be thought of as viewing the band edgewise, the magnetic sensor 31 is mounted so that the timing marks pass in close proximity to the sensor as the band cycles. As is understood by those skilled in the art, the pattern of the timing marks on the band is encoded so that print control circuitry, such as that indicated by reference character 33, can determine the start of each sequence of characters on the band as well as the passage of individual characters.

Figure 3:
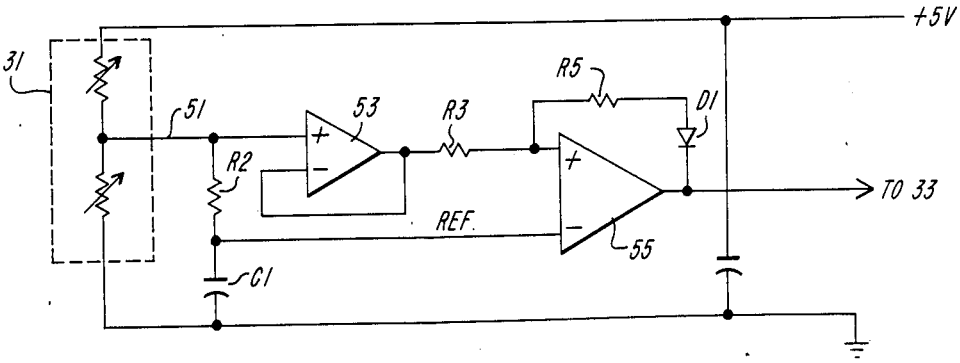
FIG. 3 is a schematic circuit diagram of sensing circuitry constructed in accordance with the present invention.
Figure 4A:
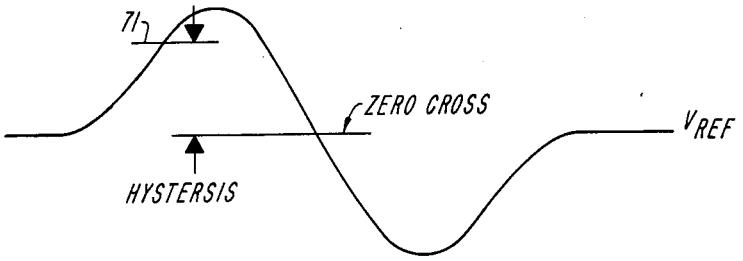
FIGS. 4*a* and 4*b* are diagrams illustrating a nominal sensor generated bipolar pulse waveform and the resultant squarewave timing signal generated by the circuitry of FIG. 3.

Assuming that the sensor 31 is of the magneto resistive type, it may be centertapped as illustrated in FIG. 3 being constructed as a voltage divider. Accordingly, when a timing mark 12 passes the sensor 31, a bipolar pulse waveform is generated, e.g. as represented in FIG. 4*a*. As indicated previously, the amplitude of this waveform and its duration are significantly variable depending on a variety of external parameters including the particular material the print band is made from, the spacing between the band, the sensitivity of the sensor, etc. Accordingly, it is desirable to determine as accurately as possible the mid-point of the bipolar waveform, i.e. the negative-going transition as shown in FIG. 4*a*. The point at which the waveform crosses the nominal d.c. level of the sensor signal may be considered a nominal zero crossing although this will not be a zero voltage level in any absolute sense with respect to supply voltages, etc.

Referring more particularly to FIG. 3, it can be seen that the source signal, i.e. the signal taken from the junction between the halves of the magneto-resistive sensor 31 is applied, through a lead 51, to both the non-inverting input terminal of a differential amplifier 53 and to a low pass filter comprising a resistor R2 and a capacitor C1. The filtering network provides, at the junction between resistor R2 and capacitor C1, a d.c. reference voltage which is substantially equal to the nominal d.c. level of the source signal.

The output terminal of amplifier 53 is connected directly to the inverting input of that amplifier so that the amplifier operates essentially as a voltage follower providing, at low impedance, a voltage signal which tracks the source signal, i.e. a "buffered" source signal. This buffered source signal is applied, through a first mixing resistance R3 to the non-inverting input terminal of a second differential operational amplifier 55. As will be apparent hereinafter, this non-inverting input terminal acts as a summing junction. The output terminal of the differential operational amplifier 55 is connected back to the same non-inverting terminal through a diode D1 and a second mixing resistance R5. Thus, the summing junction receives a first signal component which is a linear function of the source signal and a second signal component which is a non-linear function of the amplifier output. The d.c. reference voltage obtained from the low pass filter is applied to the inverting input terminal of the second differential operational amplifier 55.

The second differential operational amplifier 55 functions in one sense as a comparator which compares the source signal with the nominal d.c. reference voltage and generates a square-wave output signal synchronized with the source signal. To make the system resistant to noise and drift of the nominal d.c. level, however, the system incorporates hysteresis, the hystereis being applied in one direction only by means of the non-linear feedback provided through diode D1 and resistance R5. The advantage of the unidirectional feedback or hysteresis is that the nominal zero crossing may be detected without significant offset so that one edge of the squarewave output signal is precisely aligned in time with the nominal zero crossing while still providing a substantial offset for the threshold which determines the other edge of the squarewave output signal. Accordingly, the system is relatively insensitive to low level noise and to gradual drift of the nominal d.c. voltage.

Figure 4B:
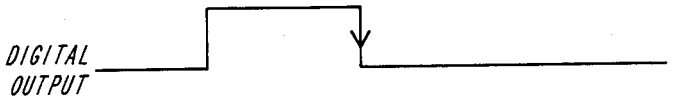

Operation of the circuit of FIG. 3 is illustrated in FIGS. 4*a* and 4*b*. Assuming the output signal is initially low, the feedback network comprising diode D1 and resistor R5 biases the summing junction negatively with respect to the d.c. reference voltage so that the source signal must rise to a corresponding threshold, designated by reference character 71, before the output signal goes high. This transition in the squarewave output signal, however, is not utilized by the subsequent circuitry as the timing reference. Once the output signal has gone high, however, no bias is applied from the hysteresis feedback network to the summing junction and thus the output signal will go low just as the source signal crosses the d.c. reference level, this being the nominal zero crossing as desired.

While the polarities illustrated are preferred in the context in which the present invention was developed, it should be understood that other permutations of polarities could be used which would still provide the principal advantage of the present invention, i.e that one of the transitions in the square-wave output signal will be quite precisely aligned with the nominal zero crossing. For example, the magneto resistive sensor end terminals might be interchanged in the divider circuitry or the polarity of the diode D1 might be reversed. It is, however, preferable that the shorter phase of the squarewave output signal be the phase during which the non-linear feedback network is providing a bias to the summing junction since the system is more resistant to noise during this phase than during the phase when no bias is applied to the summing junction.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A print band timing mark detector comprising:
- a sensing circuit including a sensor for providing a source signal, said source signal exhibiting a bipolar pulse responsive to the passing of a print band timing mark;
- low pass filter means for providing a d.c. reference voltage substantially equal to the nominal d.c. level of said source signal;
- amplifier means having inverting and non-inverting inputs and operative to generate an output which is a function of the difference of the inputs;
- means for applying said d.c. reference voltage to said inverting input;
- means for applying to said non-inverting input a first signal component which is a linear function of said source signal;
- means for applying to said non-inverting input a second signal component which is a non-linear function of the amplifier output
- whereby said amplifier responds to the passage of print band timing marks by generating a square-wave signal having one edge which is aligned with the nominal zero crossing of the bipolar pulse.

2. A detector as set forth in claim 1 wherein said sensor circuit comprises a magneto-resistive sensor connected as a three terminal voltage divider across a d.c. supply voltage.

3. A detector as set forth in claim 2 wherein said low pass filter means includes a series resistor and a shunt capacitor.

4. A detector as set forth in claim 1 wherein said means for applying said first signal component includes a voltage follower amplifier and a first mixing resistance.

5. A detector as set forth in claim 1 wherein said means for applying said second signal component includes a diode and a resistor connected in series between the output of said amplifier and said non-inverting input.

6. A print band timing mark detector comprising:
- a sensing circuit for providing a source signal, said sensing circuit including a sensor operative to generate in said source signal a bipolar pulse responsive to the passing of a print band timing mark;
- filter means including a capacitor for providing a d.c. reference voltage substantially equal to the nominal d.c. level of said source signal;
- amplifier means having inverting and non-inverting inputs and operative to generate an output which is a function of the difference of the inputs;
- means for applying said d.c. reference voltage to said inverting input;
- means for applying to said non-inverting input, through a first mixing resistance, a first signal component which is a linear function of said source signal;
- means for applying to said non-inverting input, through a second mixing resistance and a diode, a second signal component which is a non-linear function of the amplifier output
- whereby said amplifier responds to the passage of print band timing marks by generating a square-wave signal having one edge which is precisely aligned with the nominal zero crossing of the bipolar pulse generated by said sensing circuit.

7. A timing mark detector for print bands carrying raised timing marks comprising:
- a sensing circuit for providing a source signal, said sensing circuit including a magnetic sensor operative to generate in said source signal a bipolar pulse responsive to the passing of a print band timing mark;
- RC filter means including a series resistance and a shunt capacitor for providing a d.c. reference voltage substantially equal to the nominal d.c. level of said source signal;
- amplifier means having inverting and non-inverting inputs and operative to generate an output which is a function of the difference of the inputs;
- means for applying said d.c. reference voltage to said inverting input;
- circuit means for applying to said non-inverting input, through a voltage follower amplifier and a first mixing resistance, a first signal component which is a linear function of said source signal;
- means for applying to said non-inverting input, through a second mixing resistance and a diode, a second signal component which is a non-linear function of the amplifier output
- whereby said amplifier responds to the passage of print band timing marks by generating a square-wave signal having one edge which is precisely aligned with the nominal zero crossing of the bipolar pulse generated by said sensing circuit.

* * * * *